US011084300B2

(12) United States Patent
Nakamura et al.

(10) Patent No.: US 11,084,300 B2
(45) Date of Patent: Aug. 10, 2021

(54) LIQUID DISCHARGE HEAD

(71) Applicant: CANON KABUSHIKI KAISHA, Tokyo (JP)

(72) Inventors: Yohei Nakamura, Yokohama (JP); Akio Saito, Machida (JP); Zentaro Tamenaga, Sagamihara (JP); Toru Nakakubo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/656,336

(22) Filed: Oct. 17, 2019

(65) Prior Publication Data

US 2020/0122476 A1 Apr. 23, 2020

(30) Foreign Application Priority Data

Oct. 23, 2018 (JP) ..... JP2018-199545

(51) Int. Cl.
*B41J 2/14* (2006.01)
*B41J 2/335* (2006.01)

(52) U.S. Cl.
CPC ..... *B41J 2/3351* (2013.01); *B41J 2/14072* (2013.01); *B41J 2/33515* (2013.01); *B41J 2/33535* (2013.01)

(58) Field of Classification Search
CPC .. B41J 2/3351; B41J 2/33535; B41J 2/33515; B41J 2202/20; B41J 2/14072
See application file for complete search history.

(56) References Cited

U.S. PATENT DOCUMENTS

2003/0193545 A1* 10/2003 Boucher ..... H01L 23/3185 347/50
2006/0027937 A1* 2/2006 Benson ..... B41J 2/14072 257/787
2017/0297333 A1* 10/2017 Kohda ..... B41J 2/175

FOREIGN PATENT DOCUMENTS

JP 4455577 B2 4/2010

* cited by examiner

*Primary Examiner* — Yaovi M Ameh
(74) *Attorney, Agent, or Firm* — Canon U.S.A., Inc., IP Division

(57) ABSTRACT

A liquid discharge head includes a recording element substrate. The recording element substrate includes a discharge aperture forming member defining a discharge aperture from which a liquid is discharged and a substrate having a pressure generating element that pressurizes the liquid so as to discharge the liquid. The liquid discharge head also includes a cover member that defines an opening through which the discharge aperture is exposed. The cover member is disposed on a side of the recording element substrate on which the discharge aperture is formed. In the liquid discharge head, the recording element substrate further includes an electrode disposed on a side of the substrate on which the discharge aperture forming member is formed and an insulation member that covers the electrode. In addition, the insulation member is covered by the cover member.

12 Claims, 9 Drawing Sheets

LIQUID DISCHARGE HEAD

BACKGROUND OF THE INVENTION

Field of the Invention

The present disclosure relates to a liquid discharge head that discharges a liquid.

Description of the Related Art

In general, a liquid discharge head that discharges a liquid includes a recording element substrate. The recording element substrate further includes a discharge aperture forming member in which discharge apertures for discharging the liquid are formed and a silicon substrate that has pressure generating elements that pressurize the liquid and thereby discharge the liquid from respective discharge apertures. In the case in which electrodes are formed on the surface of the silicon substrate over which the discharge aperture forming member is formed, a liquid mist, which is minute liquid droplets generated in relation to liquid discharge from the discharge apertures, may adhere to the electrodes and lead to a problem, such as electrode corrosion. In a recording element substrate disclosed in Japanese Patent No. 4455577, electrodes are sealed by a sealing agent to prevent a liquid from coming into contact with the electrodes. However, if a liquid, such as a liquid mist, adheres to a sealing agent, the liquid permeates the sealing agent and may cause the sealing agent to be detached from the electrodes. If the sealing agent is detached from the electrodes, the liquid may reach the electrodes and have a negative impact on an electric circuit.

SUMMARY OF THE INVENTION

The present disclosure provides a liquid discharge head that suppresses the likelihood of a liquid coming into contact with a sealing agent that covers electrodes and thereby improves the reliability of the electric circuit therein.

The present disclosure provides a liquid discharge head that includes a recording element substrate. The recording element substrate includes a discharge aperture forming member defining a discharge aperture from which a liquid is discharged and a substrate having a pressure generating element that pressurizes the liquid so as to discharge the liquid. The liquid discharge head also includes a cover member that defines an opening through which the discharge aperture is exposed. The cover member is disposed on a side of the recording element substrate on which the discharge aperture is formed. In the liquid discharge head, the recording element substrate further includes an electrode disposed on a side of the substrate on which the discharge aperture forming member is formed and an insulation member that covers the electrode. In addition, the insulation member is covered by the cover member.

Further features of the present disclosure will become apparent from the following description of exemplary embodiments with reference to the attached drawings.

DESCRIPTION OF THE EMBODIMENTS

Liquid discharge heads according to embodiments of the present disclosure will be described with reference to the drawings. Note that the following description is not intended to limit the scope of the present disclosure. In the present embodiment, an inkjet head that discharges ink will be described as an example of a liquid discharge head but the liquid discharge head is not limited to the inkjet head. The present disclosure can be applied to various other liquid discharge heads that discharge various types of liquid droplets. In addition, the liquid discharge head is described as having a thermal system in which a liquid is discharged due to a heating element generating bubbles. However, the present disclosure can be applied to other liquid discharge heads that employ a piezoelectric system or various other discharge systems. In addition, the liquid discharge head according to the present embodiment is described as a so-called "page-wide type" head of which the longitudinal length corresponds to the width of a recording medium. However, the present disclosure can be applied to so-called "serial type" liquid discharge heads that perform scanning to record on a recording medium. For example, a serial type liquid discharge head may be configured to include one recording element substrate for a black ink and one recording element substrate for color inks. However, the serial liquid discharge head may be a type that includes a short head extending shorter than the width of the recording medium and several recording element substrates that are arranged such that discharge apertures overlap other discharge apertures in the discharge-aperture row direction, and the head performs scanning over the recording medium for recording.

The liquid discharge head according to the present embodiment is mounted on a type of recording apparatus that circulates a liquid such as ink between the liquid discharge head and a tank accommodated in the main body of the recording apparatus. However, the liquid discharge head may be mounted on other types of recording apparatuses. For example, the liquid discharge head may be mounted on a recording apparatus in which two tanks are disposed upstream and downstream of the liquid discharge head, respectively, and ink flows, from one tank to the other, exclusively inside the liquid discharge head. Alternatively, ink need not circulate inside the liquid discharge head but only a required amount of the ink for discharge may be supplied from a tank.

First Embodiment

Recording Apparatus

Figure 1:
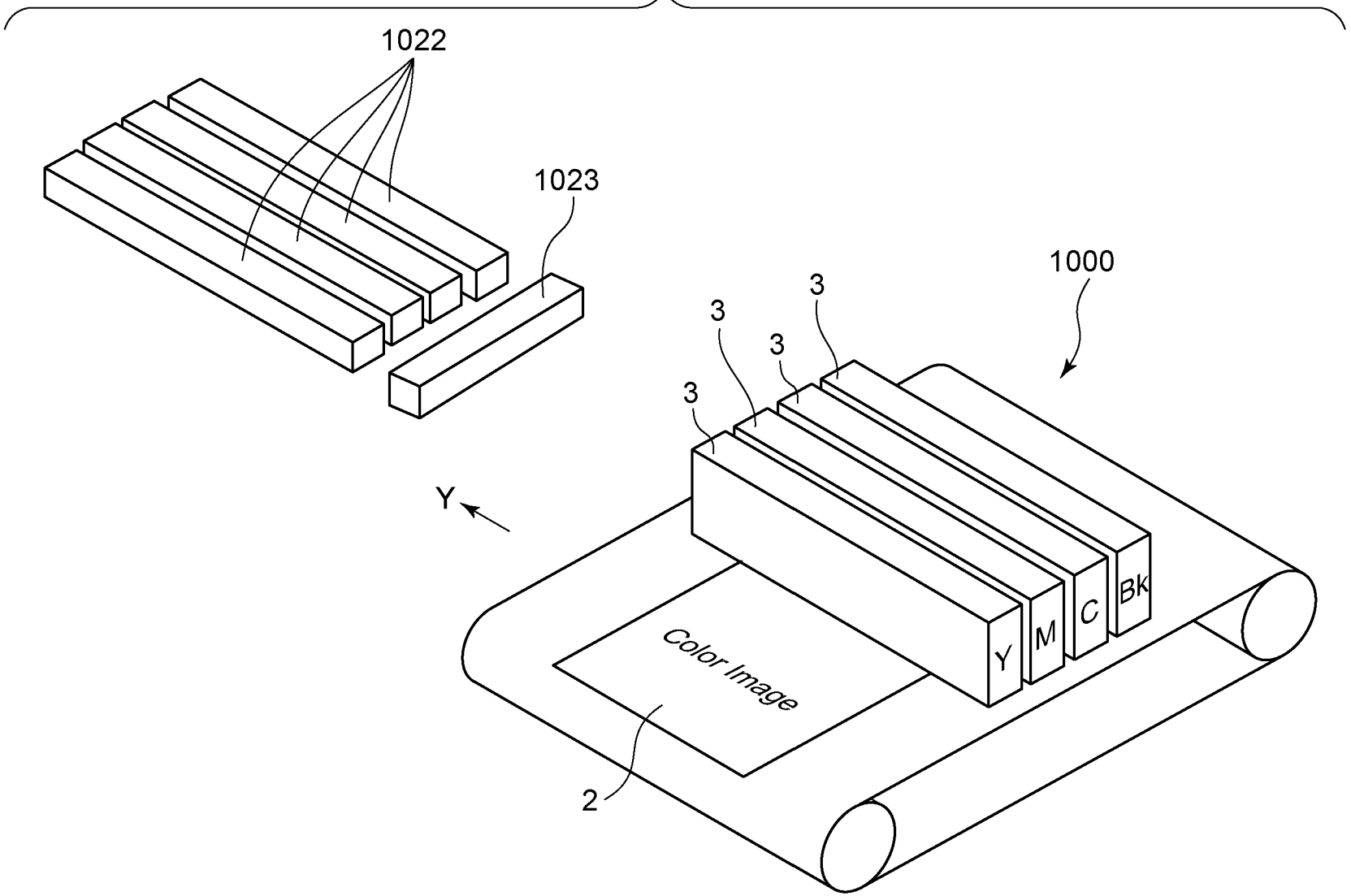
FIG. 1 is a schematic view illustrating a recording apparatus.

A recording apparatus according to the present embodiment will be described with reference to FIG. 1. FIG. 1 is a schematic view illustrating a recording apparatus 1000 equipped with liquid discharge heads 3 according to the present disclosure. The recording apparatus 1000 includes, in addition to the liquid discharge heads 3, cap members 1022 that cover respective discharge aperture surfaces of the liquid discharge heads 3 in the case of not performing recording. The recording apparatus 1000 also includes a wiping mechanism 1023 that cleans the discharge aperture surfaces. The recording apparatus 1000 also includes four single-color liquid discharge heads 3 that correspond to cyan, magenta, yellow, and black (CMYK) inks and are disposed parallel to each other so that the recording apparatus 1000 can perform full-color recording onto a recording medium 2. In the present embodiment, the number of rows of the discharge apertures that are available for each color is 20. Accordingly, recording data is distributed appropriately to multiple discharge aperture rows, which enables high-speed recording. Moreover, even in the case of a discharge aperture being unable to discharge ink due to ink adherence or the like, discharge apertures in another row corresponding in position to the disabled discharge aperture in the conveying direction of the recording medium 2 can discharge ink so as to compensate the disabled discharge aperture. This improves the reliability of recording operation, which makes the recording apparatus of the present embodiment suitable for commercial printing. A carriage (not illustrated) can move the liquid discharge head 3 in the Y direction in FIG. 1, which thereby enables the wiping mechanism 1023 to perform recovery operation of the liquid discharge head or the cap member 1022 to perform storage operation of the liquid discharge head.

Circulatory System

Figure 2:
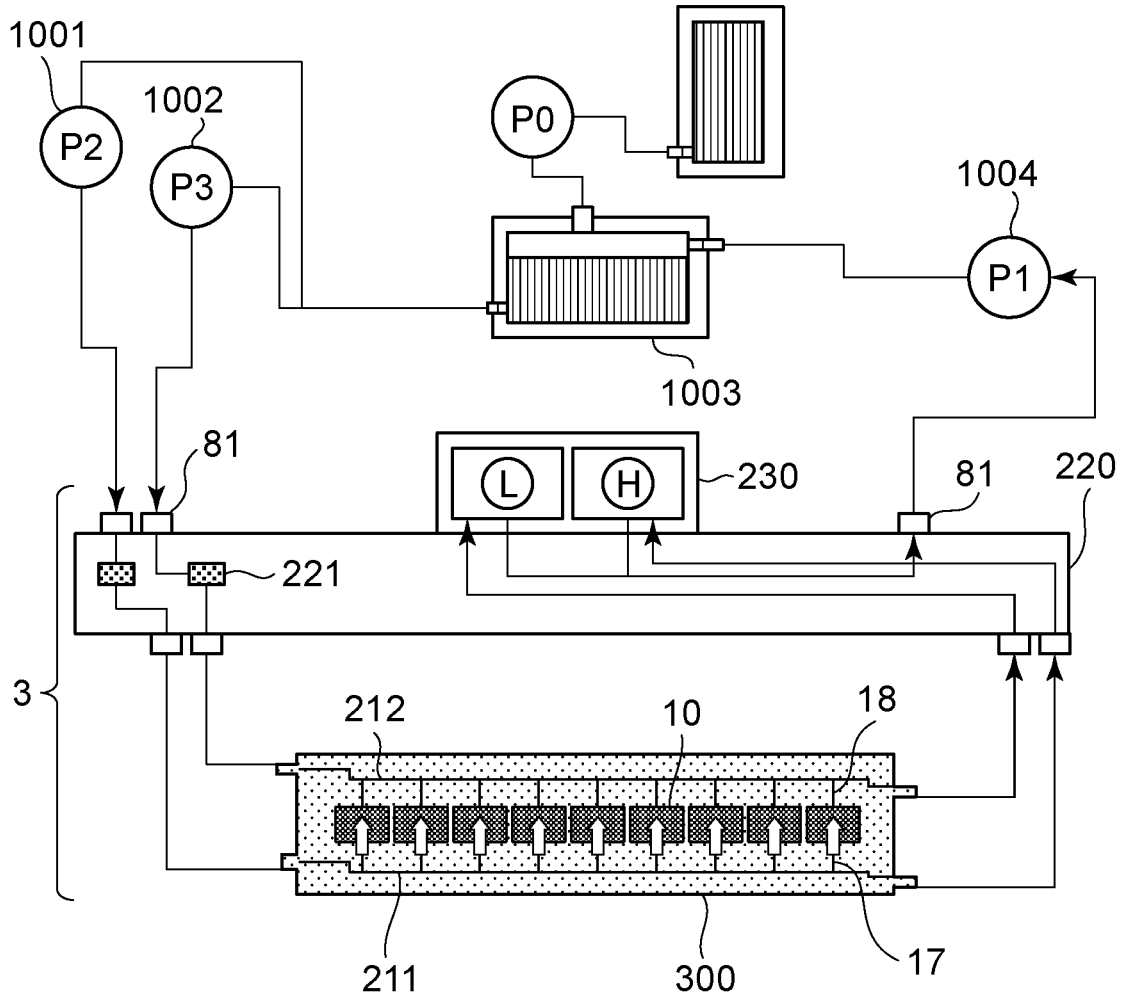
FIG. 2 is a diagram schematically illustrating a circulatory system of the recording apparatus.

The circulatory system of the recording apparatus 1000 will be described with reference to FIG. 2. FIG. 2 is a diagram schematically illustrating a circulatory system adopted in the recording apparatus 1000 of the present embodiment. Two pressure regulation mechanisms constitute a negative pressure control unit 230. The two pressure regulation mechanisms control corresponding line pressures upstream of the negative pressure control unit 230 in such a manner that the pressures fluctuate in a predetermined range with respect to a desired preset value (in other words, the two pressure regulation mechanisms operate similarly to so-called "back-pressure regulators"). A second circulation pump 1004 acts as a negative pressure source that applies a negative pressure to the downstream side of the negative pressure control unit 230. In addition, a first circulation pump (for high-pressure line) 1001 and a first circulation pump (for low-pressure line) 1002 are provided upstream of the liquid discharge head, whereas the negative pressure control unit 230 is provided downstream of the liquid discharge head.

The negative pressure control unit 230 operates in such a manner that even if the flow rate fluctuates due to the liquid discharge head changing the amount of discharge during recording, the pressure change occurring upstream of the negative pressure control unit 230 (i.e., on the upstream side where a liquid discharge unit 300 is disposed) is stabilized within a predetermined range with respect to a preset pressure. As illustrated in FIG. 2, it is preferable to provide the second circulation pump 1004 that reduces the pressure downstream of the negative pressure control unit 230 through a liquid supply unit 220. Providing the second circulation pump 1004 reduces the influence of pressure head of a buffer tank 1003 upon the liquid discharge head 3, which increases the degree of freedom in the arrangement of the buffer tank 1003 in the recording apparatus 1000. Instead of using the second circulation pump 1004, for example, a pressure head tank may be used. The pressure head tank is disposed so as to provide a predetermined pressure head relative to the negative pressure control unit 230.

The negative pressure control unit 230 includes two pressure regulation mechanisms for which different pressure regulation values are set. The two negative pressure regulation mechanisms are a high-pressure regulator (denoted by H in FIG. 2) and a low-pressure regulator (denoted by L in FIG. 2), which are respectively connected, through the liquid supply unit 220, to a common supply channel 211 and to a common collection channel 212 both of which are formed within the liquid discharge unit 300. The two negative pressure regulation mechanisms increase the pressure in the common supply channel 211 relative to the pressure in the common collection channel 212. This causes ink to flow from the common supply channel 211 to the common collection channel 212 through individual supply ports 17, internal channels of recording element substrates 10, and individual collection ports 18.

Liquid Discharge Head

Figure 3A:
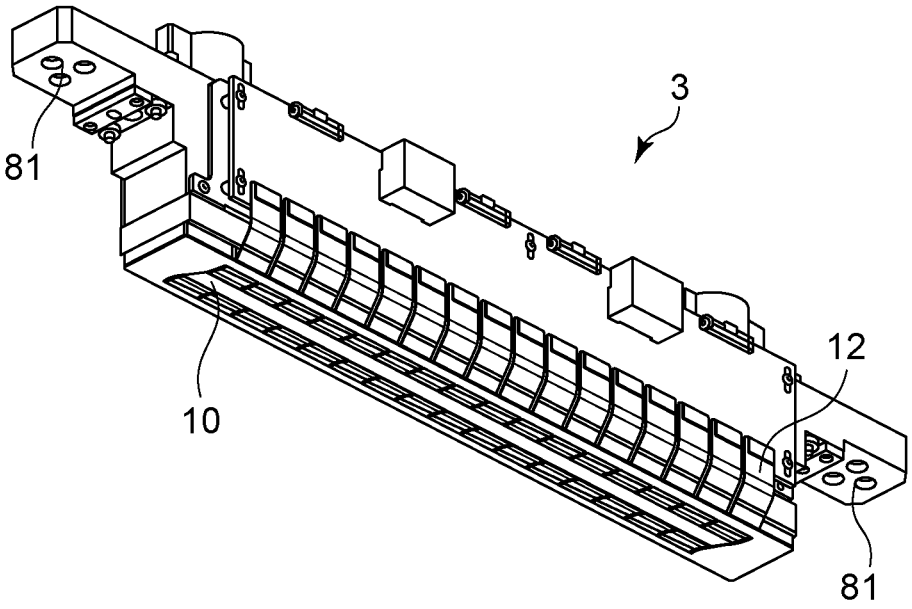
FIG. 3A and FIG. 3B are perspective views illustrating a liquid discharge head.
Figure 3B:
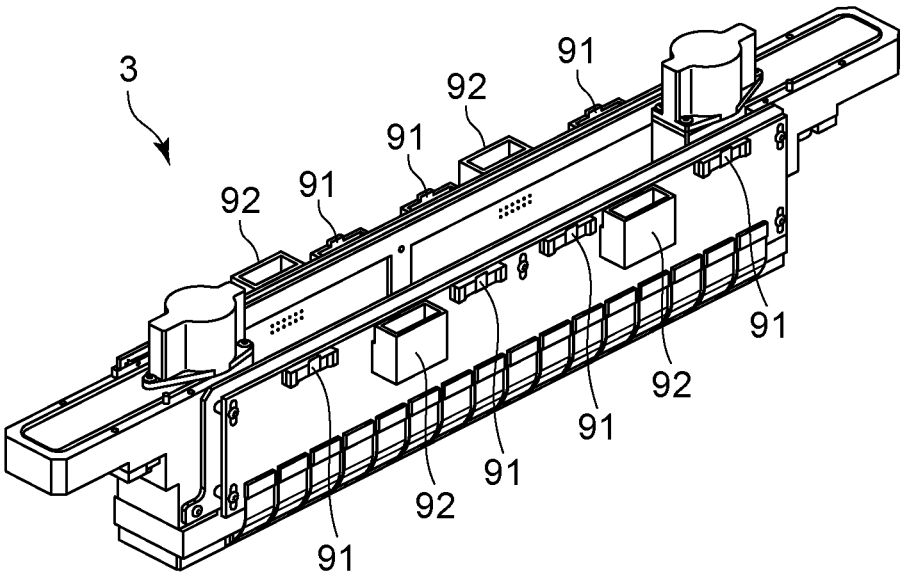
Figure 4:
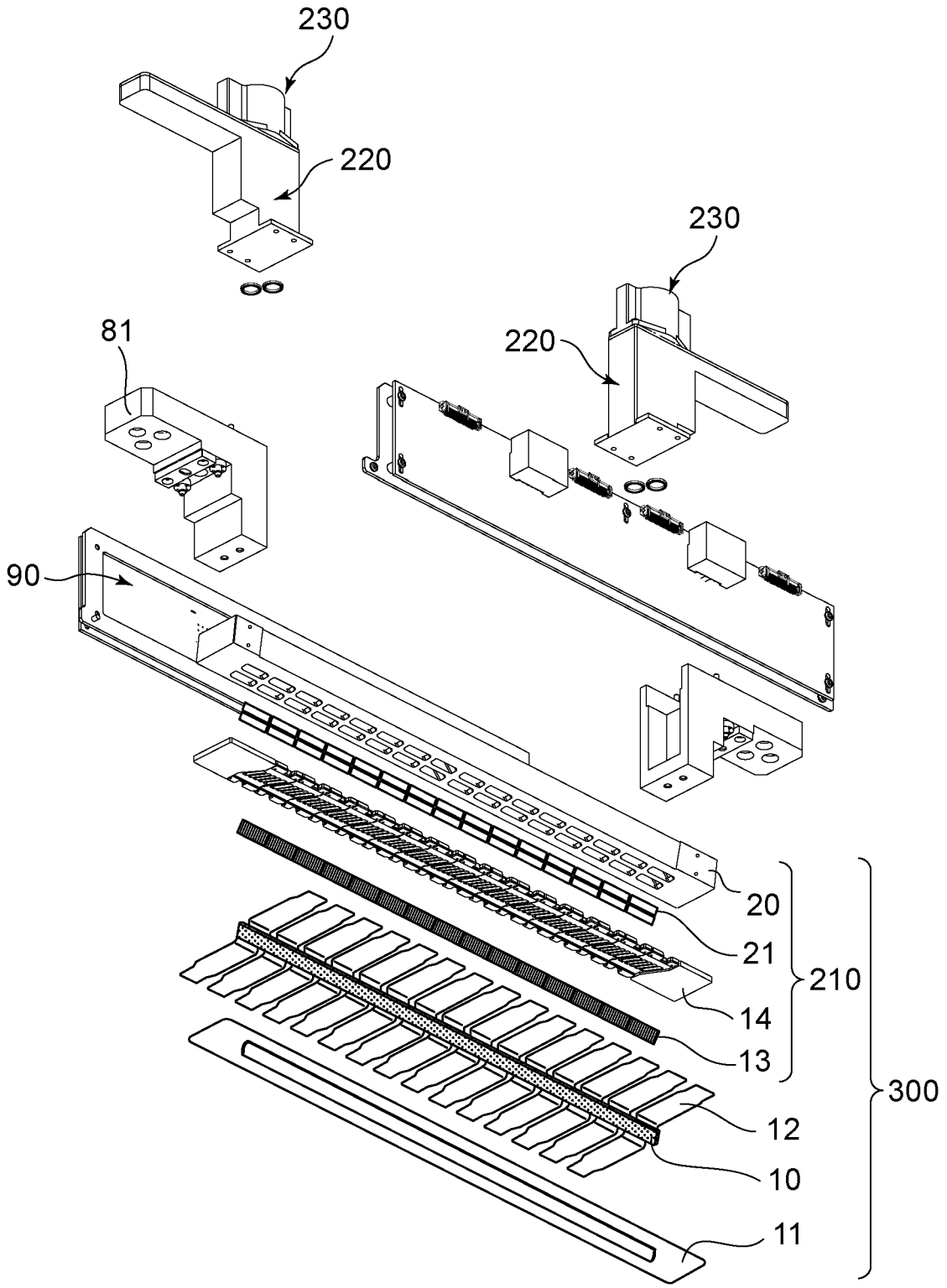
FIG. 4 is an exploded view illustrating the liquid discharge head.

A configuration of the liquid discharge head 3 will be described with reference to FIGS. 3A, 3B, and 4. FIG. 3A and FIG. 3B are perspective views illustrating the liquid discharge head 3 according to the present embodiment. FIG. 4 is an exploded view illustrating the liquid discharge head 3, in which components or units that constitute the liquid discharge head 3 are illustrated in a functionally divided manner. The liquid discharge head 3 is a page-wide type recording head employing an inkjet recording system, which includes sixteen recording element substrates 10 arranged in a straight row in the longitudinal direction of the liquid discharge head 3. FIGS. 3A and 3B illustrate the liquid discharge head 3 in which the recording element substrates 10 are disposed in a straight row. However, the present disclosure may be applied to a liquid discharge head in which the recording element substrates 10 are arranged in a staggered manner. The liquid discharge head 3 has signal input terminals 91 and power supply terminals 92 that are electrically connected to tabularly shaped electric wiring substrates 90 (see FIG. 4). The signal input terminals 91 and the power supply terminals 92 are electrically connected to a control unit of the recording apparatus 1000 (FIG. 1). The signal input terminals 91 supply discharge actuation signals and the power supply terminals 92 supply power required for discharge operation to the recording element substrates 10 via respective electric wiring members 12. The electric wiring members 12 are, for example, flexible circuits. Since the circuitry in the electric wiring substrates 90 integrates electric wires, the number of the signal input terminals 91 and the number of the power supply terminals 92 can be reduced compared with the number of the recording element substrates 10. This can reduce the number of electric connection portions that need to be connected or disconnected when the liquid discharge head 3 is mounted in, or removed from, the recording apparatus 1000.

The rigidity of the liquid discharge head 3 is provided by a second channel member 20 included in the liquid discharge unit 300. Liquid discharge unit supporting members 81 are connected to respective opposing ends of the second channel member 20 and also joined mechanically to a carriage of the recording apparatus 1000 for positioning of the liquid discharge head 3. The electric wiring substrates 90 and the liquid supply units 220 that include respective negative pressure control units 230 are joined to the liquid discharge unit supporting members 81. Each of the two liquid supply units 220 includes a filter 221 (see FIG. 2) therein. As illustrated in FIG. 4, the negative pressure control unit 230 for the high pressure line and the negative pressure control unit 230 for the low pressure line are disposed at respective longitudinal ends of the liquid discharge head 3. Both of the common supply channel 211 (FIG. 2) and the common collection channel 212 (FIG. 2) extend in the longitudinal direction of the liquid discharge head 3, and flow directions of the liquid in respective common channels are opposite to each other. This improves heat exchange between the common supply channel 211 and the common collection channel 212 and thereby reduces the temperature difference between the two common channels. This is advantageous because the temperature difference does not occur readily between the recording element substrates 10, which reduces the occurrence of uneven recording caused by the temperature difference.

Next, a channel member 210 of the liquid discharge unit 300 will be described in detail. As illustrated in FIG. 4, the channel member 210 is constituted mainly by a first channel member 14 and the second channel member 20, both of which are laminated on each other. The channel member 210 distributes the liquid supplied from the liquid supply unit 220 to the recording element substrates 10. A first sealing member 13 is disposed between the recording element substrates 10 and the first channel member 14, and a second sealing member 21 is disposed between the first channel member 14 and the second channel member 20. The first sealing member 13 and the second sealing member 21 seal the space between members so as to prevent the liquid from leaking out. The first sealing member 13 and the second sealing member 21 are disposed so as to match the components to be assembled.

The channel member 210 functions as a channel member that enables the liquid flowing from the recording element substrates 10 to return to the liquid supply unit 220. The second channel member 20 is the channel member having the common supply channel 211 and the common collection channel 212 formed therein. The second channel member 20 also functions as a main member that provides the liquid discharge head 3 with rigidity. Accordingly, it is preferable that the second channel member 20 be made of a material having sufficient corrosion resistance against the liquid and high mechanical strength. In particular, a material, such as stainless steel (SUS), titanium, or alumina, may be preferably used. The first channel member 14 and the second channel member 20 may be formed by laminating two or more members.

Discharge Module

Figure 5A:
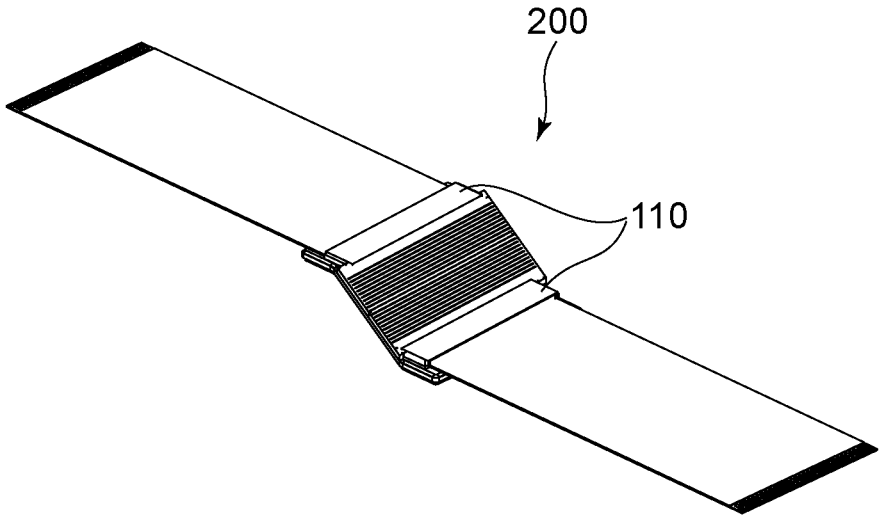
FIG. 5A is a perspective view illustrating a discharge module.
Figure 5B:
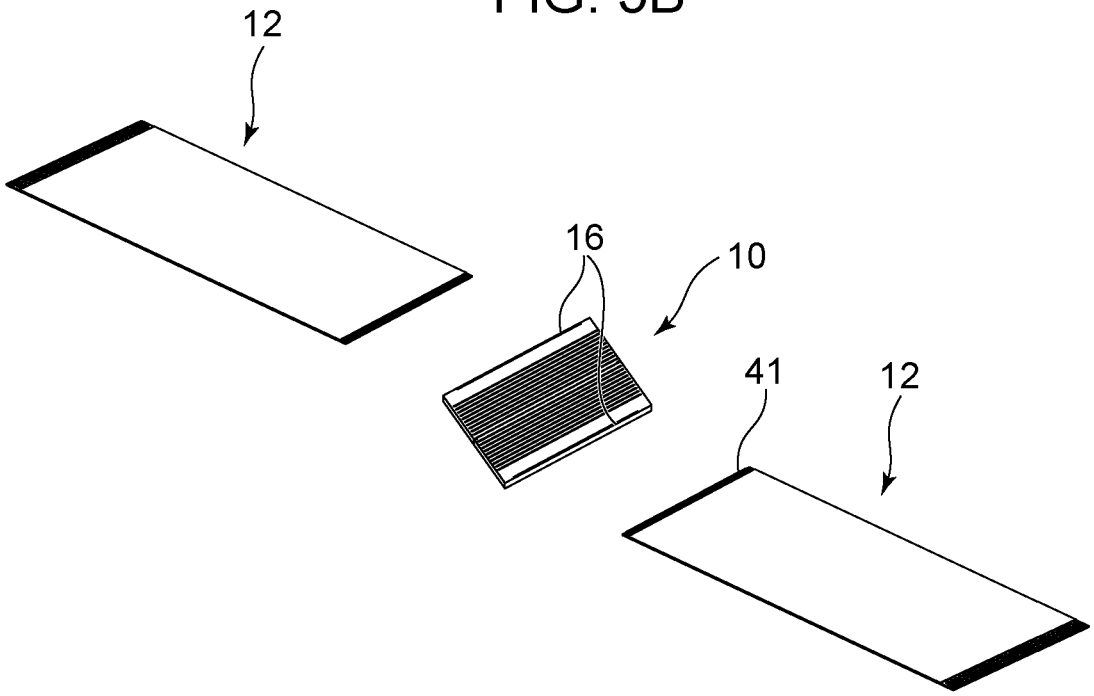
FIG. 5B is an exploded view of the discharge module.

A discharge module 200, which is constituted by a recording element substrate 10 and the electric wiring members 12, will be described with reference to FIGS. 5A and 5B. FIG. 5A is a perspective view illustrating a single discharge module 200, and FIG. 5B is an exploded view of the discharge module 200. Note that FIGS. 5A and 5B illustrates a side of the discharge module 200 that is opposite to the side on which discharge apertures 1 (see FIG. 6) are formed. Multiple back side electrodes 16 are disposed on opposing side portions of the recording element substrate 10 along the multiple rows of discharge apertures (i.e., along the long sides of the recording element substrate 10). One recording element substrate 10 is provided with two electric wiring members 12, which are connected to the back side electrodes 16. This configuration is adopted because the number of rows of discharge apertures disposed in the recording element substrate 10 is twenty and accordingly a large amount of wiring is required.

Wire bonding connects the back side electrodes 16 to the terminals 41 of the electric wiring members 12 by using gold (Au) wires (not illustrated), and the electric connection portions are sealed by a sealing agent 110. Electric connection between the back side electrodes 16 and the electric wiring members 12 enables electric signals from the recording apparatus 1000 (FIG. 1) to enter the electric wiring substrates 90 (FIG. 4) and each recording element substrate 10 via the electric wiring members 12.

Recording Element Substrate

Figure 6:
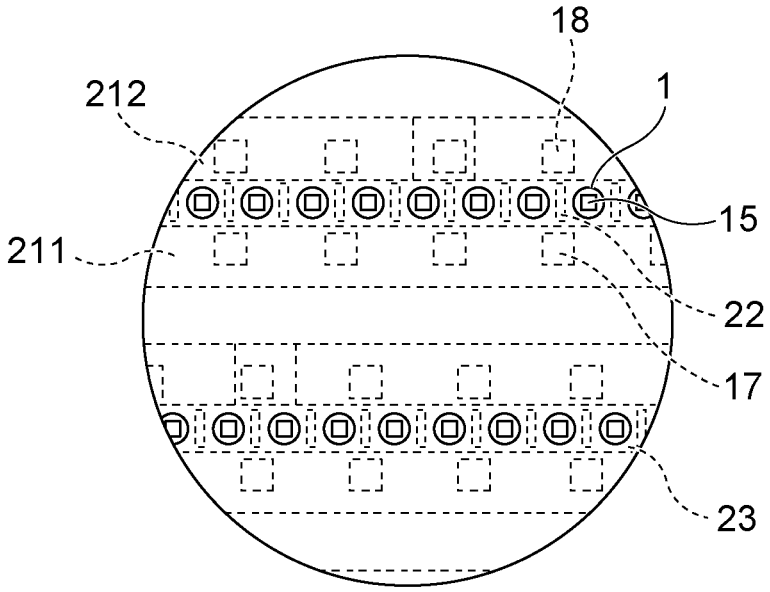
FIG. 6 is an enlarged view illustrating a recording element substrate.

A recording element substrate 10 will be described with reference to FIG. 6. FIG. 6 is an enlarged view illustrating the recording element substrate 10. As illustrated in FIG. 6, a pressure generating element 15 is disposed at a position corresponding to an individual discharge aperture 1. The pressure generating element 15 applies a required amount of pressure to a liquid to discharge the liquid from the discharge aperture 1. The pressure generating element 15 is, for example, a heater, which is a heating element for heating the liquid. Heating the liquid generates bubbles in the liquid, and the pressure generated by bubble formation causes the liquid to be discharged. A partition 22 defines a pressure chamber 23 in which the energy generating element 15 is disposed. Each pressure generating element 15 is electrically connected to the back side electrodes 16 illustrated in FIG. 5B by electric wiring (not illustrated) formed in the recording element substrate 10. The liquid flows through the pressure chamber 23 from the individual supply port 17 to the individual collection port 18.

The liquid evaporates near the discharge aperture and becomes viscous. However, with this configuration, the liquid flow can cause the viscous liquid to flow downstream and thereby suppress the likelihood of the liquid increasing the viscosity in the pressure chamber 23. The individual supply port 17 and the individual collection port 18 are formed for each discharge aperture and respectively connected to the common supply channel 211 and the common collection channel 212 as illustrated in FIG. 2.

Cover Member

Figure 7A:
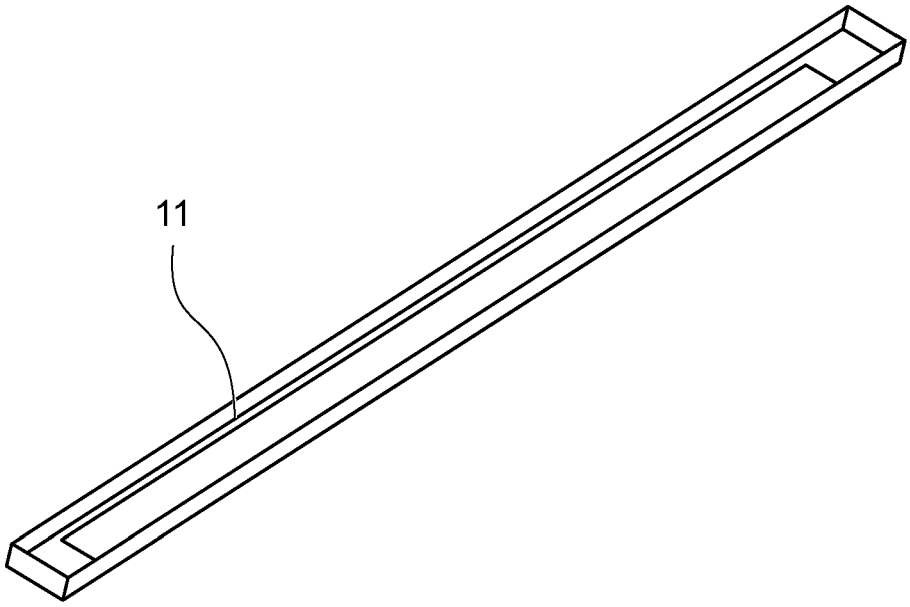
FIG. 7A is a perspective view illustrating a cover member.
Figure 7B:
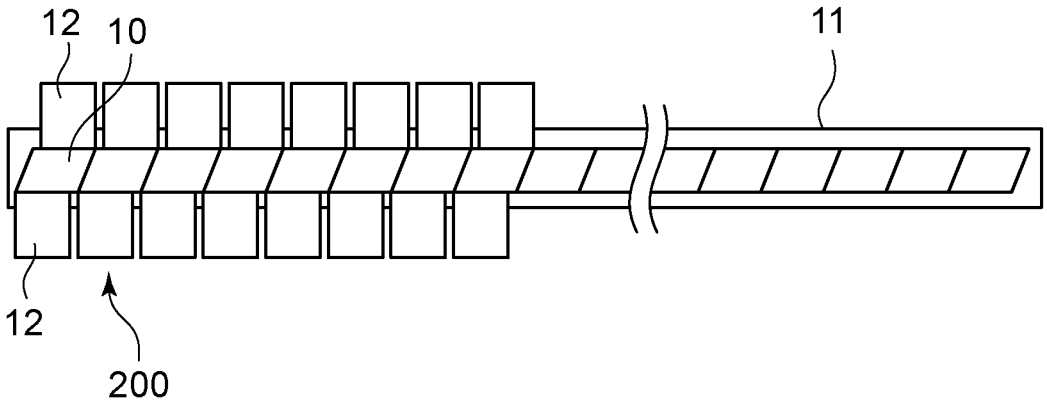
FIG. 7B is a schematic view illustrating a plurality of the discharge modules and the cover member.

A cover member according to the present embodiment will be described with reference to FIGS. 7A and 7B. FIG. 7A is a perspective view illustrating a cover member 11, and FIG. 7B is a schematic view illustrating a state in which the cover member 11 is joined to a structure on which multiple discharge modules 200 are arranged. FIG. 7B illustrates the backsides of the recording element substrates 10. In order to simplify the explanation, the electric wiring members 12 are illustrated only for some of the recording element substrates 10.

As illustrated in FIG. 7A, the cover member 11 is shaped like a frame that defines an opening through which the regions of the recording element substrates 10 having discharge apertures formed therein are exposed. In addition, as illustrated in FIG. 7B, the side of each recording element substrate 10 on which discharge apertures are formed is fixed to the inner surface of the frame by using an adhesive (not illustrated). The cover member 11 may be made of a various type of material, such as a resin or a metal, but a metal such as stainless steel (SUS) may be preferable from a strength point of view. In the case of a resin, it is preferable from a strength point of view to use a resin containing a filler.

The recording element substrate 10 of each discharge module 200 is joined to the cover member 11 disposed on the discharge port side of the liquid discharge head 3, which enables the discharge module 200 to be positioned near the discharge port. As a result, the dimensional tolerance and joining tolerance of the members can be made small compared with a case in which the recording element substrates are joined to the multiple supporting members that are stacked on each other. This improves depositing accuracy of the liquid discharged onto a recording medium from discharge apertures.

Structure Around Front Side Electrode

Figure 8:
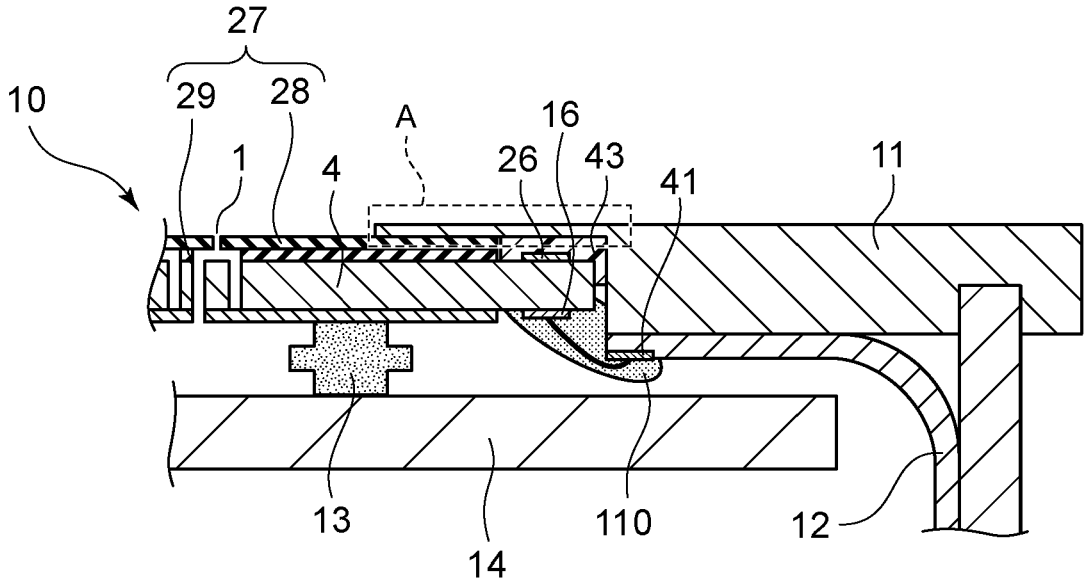
FIG. 8 is an enlarged cross-sectional view illustrating a liquid discharge unit according to a first embodiment.

A structure around the front side electrode, which is a characteristic part of the present disclosure, will be described with reference to FIG. 8. FIG. 8 is an enlarged cross-sectional view illustrating part of the liquid discharge unit 300 (FIGS. 3A, 3B). Note that the second channel member 20 and the second sealing member 21 are omitted in FIG. 8 for convenience of explanation. The recording element substrate 10 is constituted by a silicon substrate 4 made of silicon and a discharge aperture forming member 27. The discharge aperture forming member 27 includes a discharge aperture forming layer 28 in which discharge apertures 1 are formed and a channel forming layer 29 through which the liquid is supplied to the discharge apertures 1.

A front side electrode 26 illustrated in FIG. 8 may be, for example, connected to a back side electrode 16 formed on the back side of a recording element substrate 10 and may be used as a test terminal for checking the state of an electric circuit (not illustrated) formed in the recording element substrate 10. In the case of the front side electrode 26 being used as the test terminal, the operation of the electric circuit connected to the front side electrode 26 is first checked through the front side electrode 26. Subsequently, the front side electrode 26 is electrically connected to the back side electrode 16 and the electric circuit is operated through the back side electrode 16 thereafter. Note that in addition to the use of the test terminal, the front side electrode 26 can be used as an electric connection portion to be connected to a terminal outside the liquid discharge head to actuate the pressure generating element 15 and discharge the liquid from the corresponding discharge aperture. In the present embodiment, the front side electrode 26 and the back side electrode 16 are electrically connected to each other by using a via hole electrode (not illustrated). The via hole electrode is installed by forming a through-hole (not illustrated) between the front side electrode 26 and the back side electrode 16 through the silicon substrate 4 of the recording element substrate 10 and by plating the inner surface of the through-hole with a metal. However, the present disclosure is not limited to this method. The electric connection may be achieved by using various methods, for example, by using gold (Au) wires (not illustrated) installed by so-called wire bonding.

An insulation member is disposed over the front side electrode 26 so as to prevent electrical contact between the front side electrode 26 and adjacent other front side electrodes (not illustrated) or the cover member 11. In the present embodiment, a sealing member 43 is used as the insulation member. The sealing member 43 is, for example, epoxy resin. In addition, the cover member 11 is disposed so as to cover the sealing member 43 in order to prevent the sealing member 43 from coming into contact with a liquid (ink), which characterizes the present disclosure. If the sealing member 43 is not covered, ink coming from the discharge aperture, such as ink mist, adheres to the sealing member, and the adhering ink permeates the sealing member 43. As a result, the sealing member 43 may be detached and the ink may adhere to the front side electrode 26. In the present disclosure, as illustrated in FIG. 8, covering the surface of the sealing member 43 with the cover member 11 can suppress adhesion of ink to the sealing member 43 and detachment of the sealing member 43. This can suppress the likelihood of a short circuit occurring to the electric circuit (not illustrated) due to the ink coming into contact with the front side electrode 26, and accordingly, this can reduce the likelihood of the liquid discharge head malfunctioning. The sealing member 43 can be used as an adhesive for joining the recording element substrate 10 to the cover member 11. However, the recording element substrate 10 may be joined to the cover member 11 by using a separate adhesive, other than the sealing member 43, which is applied to a region of the recording element substrate 10 on which the front side electrodes 26 are not present.

As illustrated in FIG. 8, an extension portion (i.e., region A) of the cover member 11 protrudes over the recording element substrate 10 like a canopy. The cover member 11 is fixed to the first channel member and the second channel member by using bolts, which thereby presses the extension portion A against the sealing member 43. The cover member 11 comes into close contact with the sealing member 43 so that ink cannot enter easily from the discharge aperture surface. In addition, the extension portion A of the cover member 11 overlaps the back side electrodes 16 disposed on the back side of the recording element substrate 10 as viewed in the direction of discharging ink from the discharge aperture. As a result, when the electric wiring members 12 are electrically connected to the back side electrodes 16 by wire bonding, the cover member 11 can bear the load applied to the back side electrodes 16, which leads to a reliable electrical connection.

Second Embodiment

Figure 9:
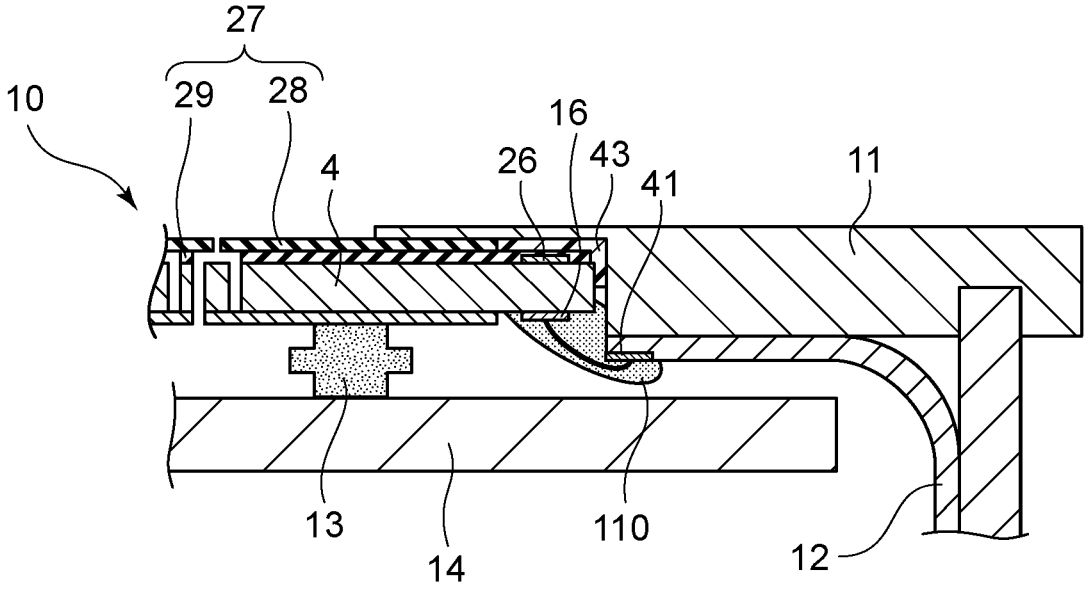
FIG. 9 is an enlarged cross-sectional view illustrating a liquid discharge unit according to a second embodiment.

A second embodiment according to the present disclosure will be described with reference to FIG. 9. FIG. 9 is an enlarged cross-sectional view illustrating part of a liquid discharge unit 300 (FIGS. 3A, 3B) according to the second embodiment. Note that elements similar to those in the first embodiment will be denoted by the same reference symbols and duplicated descriptions will be omitted. A characteristic part of the present embodiment is that a member that seals the front side electrode 26 is not the sealing member 43 (FIG. 8) but the channel forming layer 29 that constitutes the discharge aperture forming member 27. The channel forming layer 29 has insulation properties and can insulate adjacent front side electrodes 26 from each other. Covering the front side electrode 26 with the channel forming layer 29 suppresses the likelihood of the liquid coming into contact with the front side electrode 26 since the liquid needs to go around the edge of the channel forming layer 29 to reach the front side electrode 26.

Moreover, as illustrated in FIG. 9, the channel forming layer 29, which is the insulation member that covers the front side electrode 26, is further covered by the sealing member 43, which thereby seals the interface between the channel forming layer 29 and the silicon substrate 4, prevents infiltration of ink more reliably, and improves electric reliably. The extension portion A of the cover member 11 protrudes over the recording element substrate 10 like a canopy and is pressed by bolts into close contact with the recording element substrate 10 almost without allowing a gap. Accordingly, ink cannot enter easily from the discharge aperture surface. Note that an adhesive or the sealing member 43 may be used to adhere the channel forming layer 29 and the cover member 11 to each other. In the case of using the sealing member 43, a step of applying an adhesive can be eliminated, which simplifies the manufacturing process of the liquid discharge head.

Third Embodiment

Figure 10:
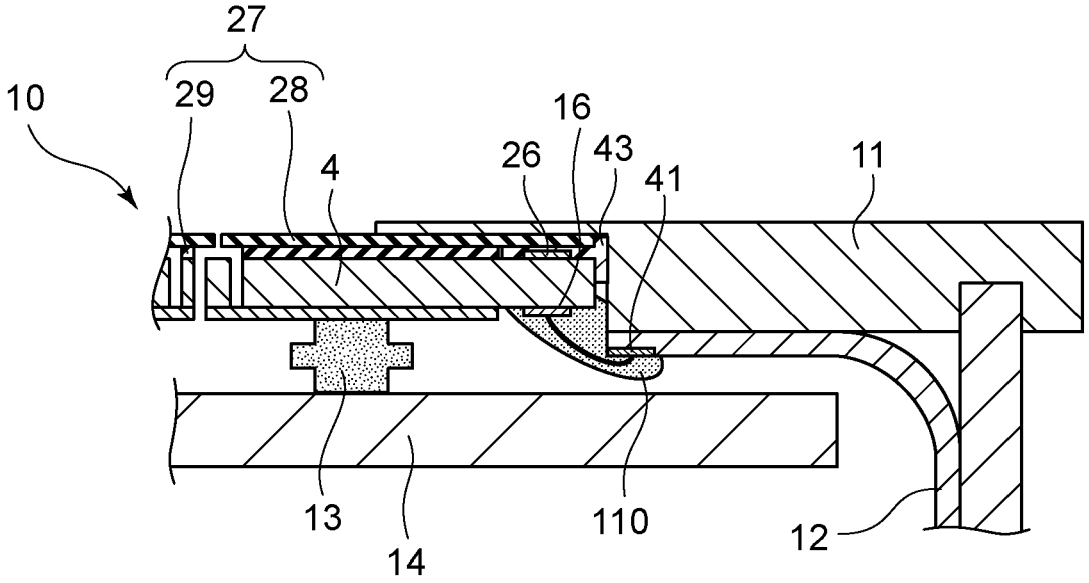
FIG. 10 is an enlarged cross-sectional view illustrating a liquid discharge unit according to a third embodiment.

A third embodiment according to the present disclosure will be described with reference to FIG. 10. FIG. 10 is an enlarged cross-sectional view illustrating part of a liquid discharge unit 300 (FIG. 3) according to the third embodiment. Note that elements similar to those in the first embodiment will be denoted by the same reference symbols and duplicated descriptions will be omitted. A characteristic part of the present embodiment is that the discharge aperture forming layer 28 that constitutes the discharge aperture forming member 27 is formed over sealing member 43 that seals the front side electrode 26. Note that in FIG. 8, which is the illustration related to the first embodiment, the discharge aperture forming layer 28 is not formed over the front side electrode 26. In the present embodiment, however, the discharge aperture forming layer 28 is formed so as to extend over and cover the front side electrode 26 with the sealing member 43 interposed therebetween as illustrated in FIG. 10. With this configuration, the likelihood of ink reaching the front side electrode 26 can be further suppressed since the ink needs to go around the edge of the protruding discharge aperture forming layer 28 to reach the front side electrode 26.

Fourth Embodiment

Figure 11:
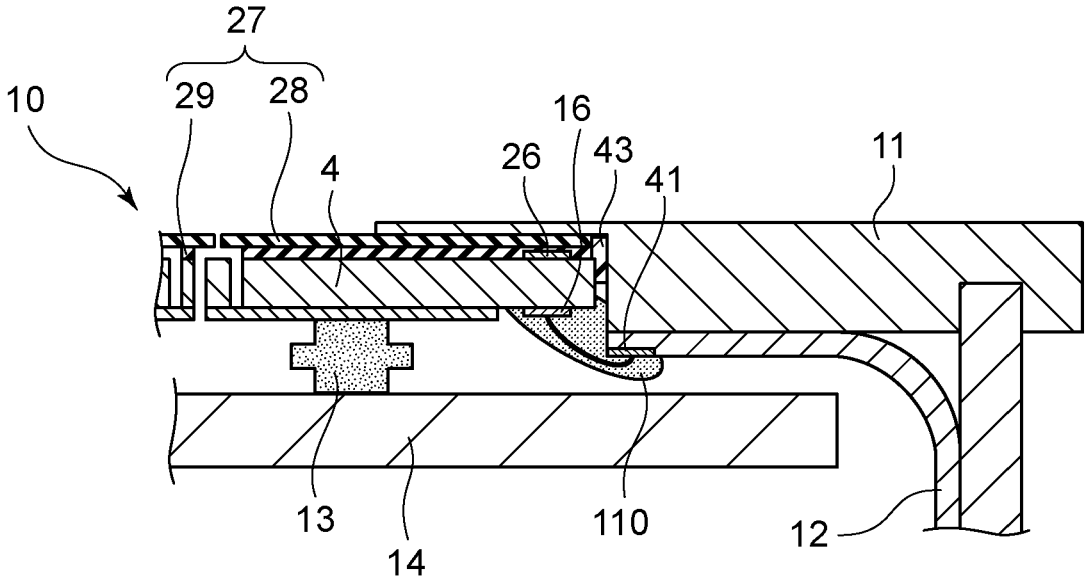
FIG. 11 is an enlarged cross-sectional view illustrating a liquid discharge unit according to a fourth embodiment.

A fourth embodiment according to the present disclosure will be described with reference to FIG. 11. FIG. 11 is an enlarged cross-sectional view illustrating part of a liquid discharge unit 300 (FIG. 3) according to the fourth embodiment. Note that elements similar to those in the first embodiment will be denoted by the same reference symbols and duplicated descriptions will be omitted. A characteristic part of the present embodiment is that the front side electrode 26 is covered and sealed by the discharge aperture forming member 27, in other words, by both the discharge aperture forming layer 28 and the channel forming layer 29. Both the discharge aperture forming layer 28 and the channel forming layer 29, which constitute the discharge aperture forming member 27, have insulation properties and can insulate adjacent front side electrodes 26 from each other.

In the case of wire bonding being used to electrically connect the back side electrodes 16 to the terminals 41 of the electric wiring members 12, a bonding tool (not illustrated) needs to be pressed against the back side electrodes 16, which applies a load to the discharge aperture forming member 27. Sealing the front side electrodes 26 with the discharge aperture forming member 27, as in the present embodiment, causes the discharge aperture forming member 27 to fill the space between the recording element substrate 10 and the cover member 11. The cover member 11 can thereby bear the load applied from the bonding tool to the discharge aperture forming member 27, which can suppress load concentration in the recording element substrate 10. Accordingly, breakage or the like of the recording element substrate 10 can be suppressed. Moreover, as is the case for the third embodiment, the likelihood of ink reaching the front side electrode 26 can be further suppressed since the ink needs to go around the edge of the protruding discharge aperture forming member 27 to reach the front side electrode 26.

In the present disclosure, in the case in which multiple insulation members that cover the front side electrodes at multiple positions are disposed in the liquid discharge head, it is sufficient that the cover member 11 covers at least one insulation member. However, it is preferable that the cover member 11 cover all of the insulation members that seal the front side electrodes.

According to the present disclosure, there is provided a liquid discharge head that can enhance the reliability of the electric circuit therein in the case in which the liquid discharge head has electrodes on a side of the substrate on which discharge apertures are formed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-199545, filed Oct. 23, 2018, which is hereby incorporated by reference herein in its entirety.

What is claimed is:

1. A liquid discharge head comprising:

a recording element substrate including, a discharge aperture forming member defining a discharge aperture from which a liquid is discharged, and a substrate having a pressure generating element that pressurizes the liquid so as to discharge the liquid; and a cover member that defines an opening through which the discharge aperture is exposed, the cover member being disposed on a side of the recording element substrate on which the discharge aperture is formed, wherein the recording element substrate further includes, an electrode disposed on a side of the substrate on which the discharge aperture forming member is formed, a back side electrode formed on a side of the substrate that is opposite to the side of the substrate on which the discharge aperture forming member is formed, and an insulation member that covers the electrode, wherein the insulation member is covered by the cover member, and wherein the electrode is electrically connected to the back side electrode.

2. The liquid discharge head according to claim 1, wherein the insulation member is a sealing member made of a resin.

3. The liquid discharge head according to claim 1, wherein the insulation member is the discharge aperture forming member.

4. The liquid discharge head according to claim 1, wherein the discharge aperture forming member includes, a discharge aperture forming layer in which a discharge aperture is formed and a channel forming layer in which a channel for supplying the liquid to the discharge aperture is formed, and wherein the insulation member is the discharge aperture forming layer.

5. The liquid discharge head according to claim 1, wherein the discharge aperture forming member includes, a discharge aperture forming layer in which a discharge aperture is formed and a channel forming layer in which a channel for supplying the liquid to the discharge aperture is formed, and wherein the insulation member is the channel forming layer.

6. The liquid discharge head according to claim 1, wherein the cover member has an electric wiring member disposed thereon, and wherein the back side electrode and the electric wiring member are electrically connected to each other by a wire.

7. The liquid discharge head according to claim 1, wherein as the side of the substrate having the discharge aperture forming member formed thereon is viewed, the back side electrode is disposed so as to overlap the cover member.

8. The liquid discharge head according to claim 1, wherein the pressure generating element is a heater that heats the liquid.

9. The liquid discharge head according to claim 1, wherein the liquid discharge head includes the multiple recording element substrates, and wherein the multiple recording element substrates are disposed in a straight row in a longitudinal direction of the liquid discharge head.

10. The liquid discharge head according to claim 1, wherein the liquid discharge head includes the multiple recording element substrates, and wherein the multiple recording element substrates are disposed in a staggered manner in a longitudinal direction of the liquid discharge head.

11. The liquid discharge head according to claim 1, wherein the liquid discharge head includes the multiple recording element substrates, and wherein the liquid discharge head is a page-wide type liquid discharge head in which the multiple recording element substrates are arranged.

12. The liquid discharge head according to claim 1, wherein a pressure chamber is formed in the recording element substrate as a cavity between the pressure generating element and the discharge aperture, wherein the recording element substrate includes a supply port that supplies the liquid to the pressure chamber, and a collection port that collects, from the pressure chamber, the liquid that has not been discharged from the discharge aperture, and wherein the liquid circulates between the pressure chamber and a region outside the pressure chamber.

* * * * *